US012018922B1

(12) United States Patent
Chamberlain et al.

(10) Patent No.: US 12,018,922 B1
(45) Date of Patent: Jun. 25, 2024

(54) UNIVERSAL CAP FOR EXPLOSIVE WATER CHARGES

(71) Applicant: Department of the Navy, Indian Head, MD (US)

(72) Inventors: Keith Chamberlain, Waldorf, MD (US); Lee Foltz, Indian Head, MD (US); Angel Diaz, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/530,249

(22) Filed: Dec. 16, 2016

(51) Int. Cl.
*F42B 33/06* (2006.01)
*F42B 3/26* (2006.01)

(52) U.S. Cl.
CPC ..... *F42B 33/062* (2013.01); *F42B 3/26* (2013.01)

(58) Field of Classification Search
CPC ..... F42B 33/06; F42B 33/062; F42B 3/26; F42B 39/20; F42D 5/04; F41B 9/0046; F41H 11/12
USPC ..... 86/50
See application file for complete search history.

(56) References Cited

U.S. PATENT DOCUMENTS

| | | | | |
|---|---|---|---|---|
| 3,517,616 | A * | 6/1970 | Martin | B65D 1/0223 102/323 |
| 3,687,076 | A * | 8/1972 | Friant | B65D 81/3222 102/331 |
| H1457 | H * | 7/1995 | Sullivan, Jr. | F42B 3/00 102/324 |
| 6,269,725 | B1 * | 8/2001 | Cherry | F42B 1/02 102/306 |
| 7,958,827 | B1 * | 6/2011 | Brock | F41A 33/04 102/498 |
| 8,677,902 | B1 * | 3/2014 | Rock | F41B 9/0046 89/1.13 |
| 8,777,032 | B2 * | 7/2014 | Biesecker | B65D 43/0212 215/224 |
| 9,470,484 | B2 * | 10/2016 | Benson | F42B 39/002 |
| 11,460,282 | B1 * | 10/2022 | Wade | F42B 33/06 |
| 11,493,301 | B1 * | 11/2022 | Brush | F42D 5/04 |
| 11,506,465 | B1 * | 11/2022 | Foltz | F42D 1/043 |
| 2005/0184024 | A1 | 8/2005 | Santa Cruz et al. | |
| 2007/0209500 | A1 | 9/2007 | Wilber | |
| 2012/0097015 | A1 | 4/2012 | Alford et al. | |
| 2014/0224101 | A1 | 8/2014 | Benson | |
| 2014/0291360 | A1 | 10/2014 | Bracha | |
| 2015/0241179 | A1 * | 8/2015 | Patel | F41H 11/12 89/1.13 |

* cited by examiner

*Primary Examiner* — Joshua E Freeman
*Assistant Examiner* — Benjamin S Gomberg
(74) *Attorney, Agent, or Firm* — Fredric J. Zimmerman

(57) ABSTRACT

A cap for an explosive water charge may be fixed to a collapsible water bottle by threading internal threads of the cap onto external threads of the water bottle. The cap also may be fixed to a water bottle by engaging a lip on the water bottle with lip grabbers on the cap. The cap is configured to hold a blasting cap and two different sizes of tubes of energetic material.

17 Claims, 6 Drawing Sheets

UNIVERSAL CAP FOR EXPLOSIVE WATER CHARGES

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The invention relates in general to explosive devices and in particular to explosive water charges.

BACKGROUND OF THE INVENTION

Omni-directional explosive water charges are used, for example, in explosive ordnance disposal (EOD) to disarm or otherwise render harmless an explosive device such as, for example, an improvised explosive device (IED). An omni-directional explosive water charge may include a water container and a tube of energetic material disposed in the water container. The energetic material may be detonated by a blasting cap. Such explosive water charges are commercially available, but often expensive.

Those in the field of EOD have a need for less expensive explosive water charges.

SUMMARY OF THE INVENTION

One aspect of the invention is a cap for an explosive water charge. The cap may include a top planar surface and a cylindrical surface that downwardly depends from the outer perimeter of the top planar surface. Screw threads may be formed on the interior of the cylindrical surface. A central cylindrical portion may extend downwardly from the top planar surface and include a central through hole. An upper portion of the central through hole may include an enlarged portion.

A sleeve may be disposed in the enlarged portion and rest on a flanged portion. The sleeve is configured to hold a detonator. A lower portion of the central through hole has a first diameter segment and a counter-bore with a larger second diameter than the first diameter segment. A plurality of lip grabbers depend downwardly from the top planar surface. The lip grabbers may be disposed radially between the screw threads and the central cylindrical portion. The plurality of lip grabbers include two sub-pluralities of lip grabbers disposed on opposite sides of the central cylindrical portion. Each lip grabber includes a slot configured to receive a lip of a water bottle.

Another aspect of the invention is an explosive water charge. The explosive water charge includes the novel cap and a water bottle. The cap may be fixed to the water bottle by engaging external threads on the water bottle with the screw threads of the cap or by engaging a lip on the water bottle with the plurality of lip grabbers of the cap.

In one exemplary embodiment, the water bottle may be a COTS drinking water bottle and the cap may be fixed to the water bottle by engaging a lip on the water bottle with the plurality of lip grabbers of the cap.

In another exemplary embodiment, the water bottle may be a collapsible water bottle having an externally threaded neck and the cap is fixed to the collapsible water bottle by engaging the external threads on the water bottle with the screw threads of the cap.

A detonator may be disposed in the cap and held by the sleeve in the cap. A tube of energetic material may be disposed in the water bottle and in the cap.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE INVENTION

One solution for reducing the cost of explosive water charges is to use commercial off the shelf (COTS) drinking water bottles, such as, for example, DEER PARK®, GREAT VALUE®, POLAR SPRINGS®, etc. Of course, the bottles must be modified to be able to hold a tube of energetic material and a blasting cap, for example. One problem with the COTS water bottles is the varying size neck at the top of the bottles. Many pre-filled types of drinking water bottles sold at retail stores have varying size threaded necks. In addition, the collapsible and reusable HYDRAPAK STASH® water bottles have a larger diameter threaded neck than the majority of the pre-filled types of water bottles.

A novel bottle cap is configured for use with various pre-filled types of water bottles as well as HYDRAPAK STASH® collapsible bottles. With the novel bottle cap, an inexpensive explosive water charge may be constructed from water bottles having a variety of different sized neck portions. Although the pre-filled types of water bottles sold at retail stores may have varying size threaded necks, most of them have a standard sized lip at the bottom of the threaded portion. The novel bottle cap is configured to engage the lip at the bottom of the threaded portion of the pre-filled types of water bottles. In addition, the novel bottle cap includes interior threads for engaging the larger neck of HYDRAPAK STASH® collapsible water bottles. Further, the bottle cap is configured to receive and hold a detonator and to receive and hold two different sizes of energetic tubes.

Figure 1:
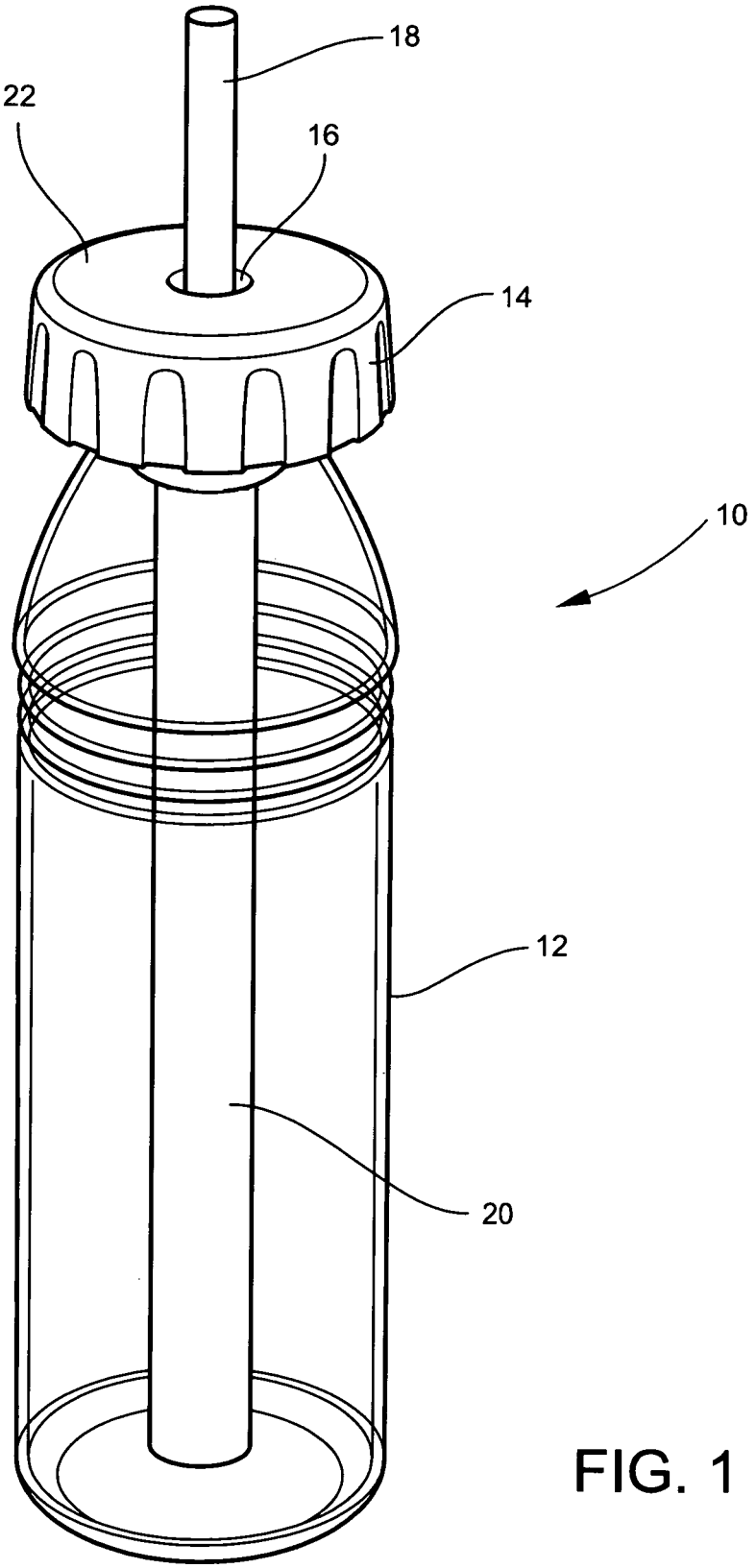
FIG. 1 is one embodiment of an explosive water charge.

FIG. 1 shows one embodiment of an explosive water charge 10. Charge 10 includes a water bottle 12. Bottle 12 may be, for example, a COTS pre-filled type of drinking water bottle such as DEER PARK®, GREAT VALUE®, POLAR SPRINGS® brands, etc. The bottle 12 is closed by a cap 14 having a top opening 16 for receiving a detonator 18, such as an electric or non-electric blasting cap. Cap 14 may have a top planar surface 22. A tube 20 of energetic material is disposed in bottle 12. In use, water is placed in bottle 12 around tube 20 and the charge 10 is placed in its desired location prior to activating detonator 18.

Figure 2:
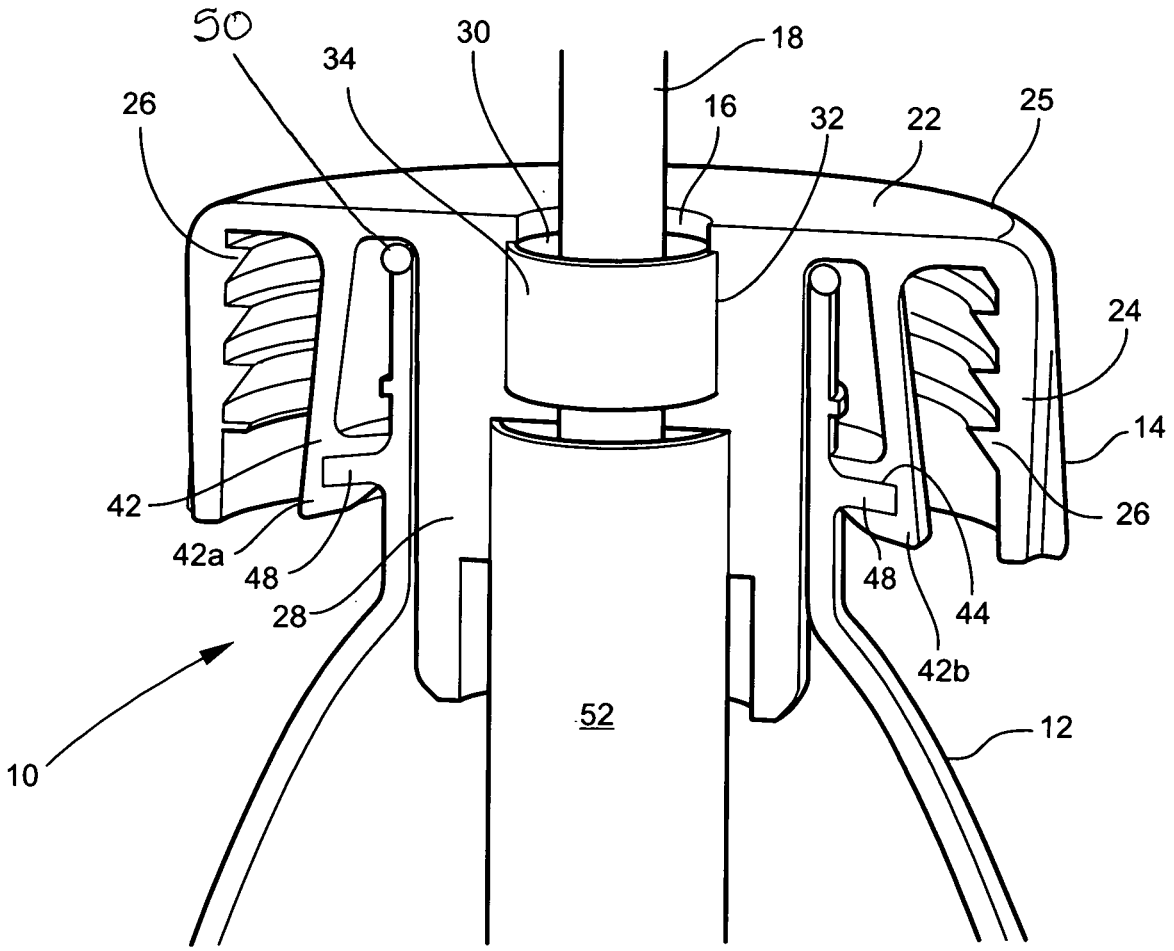
FIG. 2 is an enlarged view, partially in section, of a top portion of FIG. 1.
Figure 3:
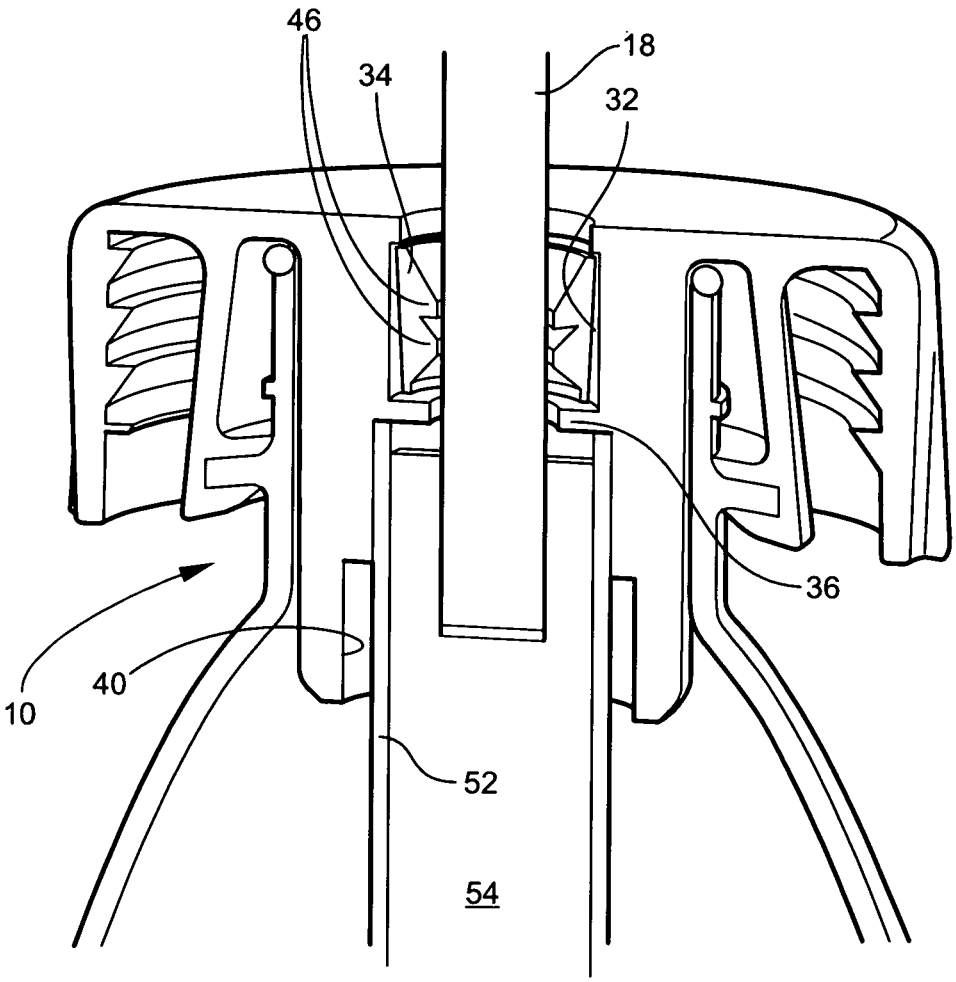
FIG. 3 is an enlarged sectional view of a top portion of FIG. 1.
Figure 4:
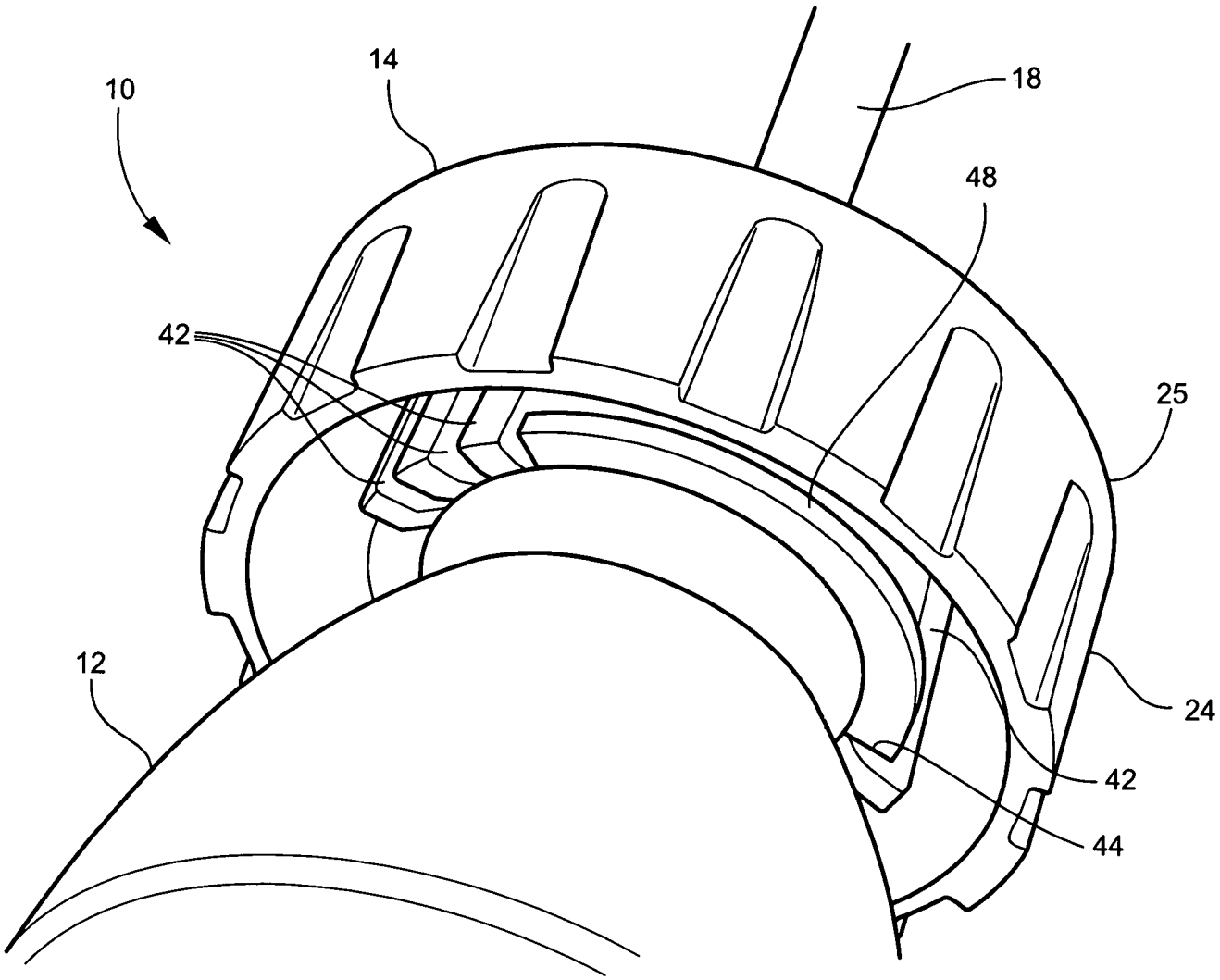
FIG. 4 is a perspective view of a top portion of the charge of FIG. 1.
Figure 5:
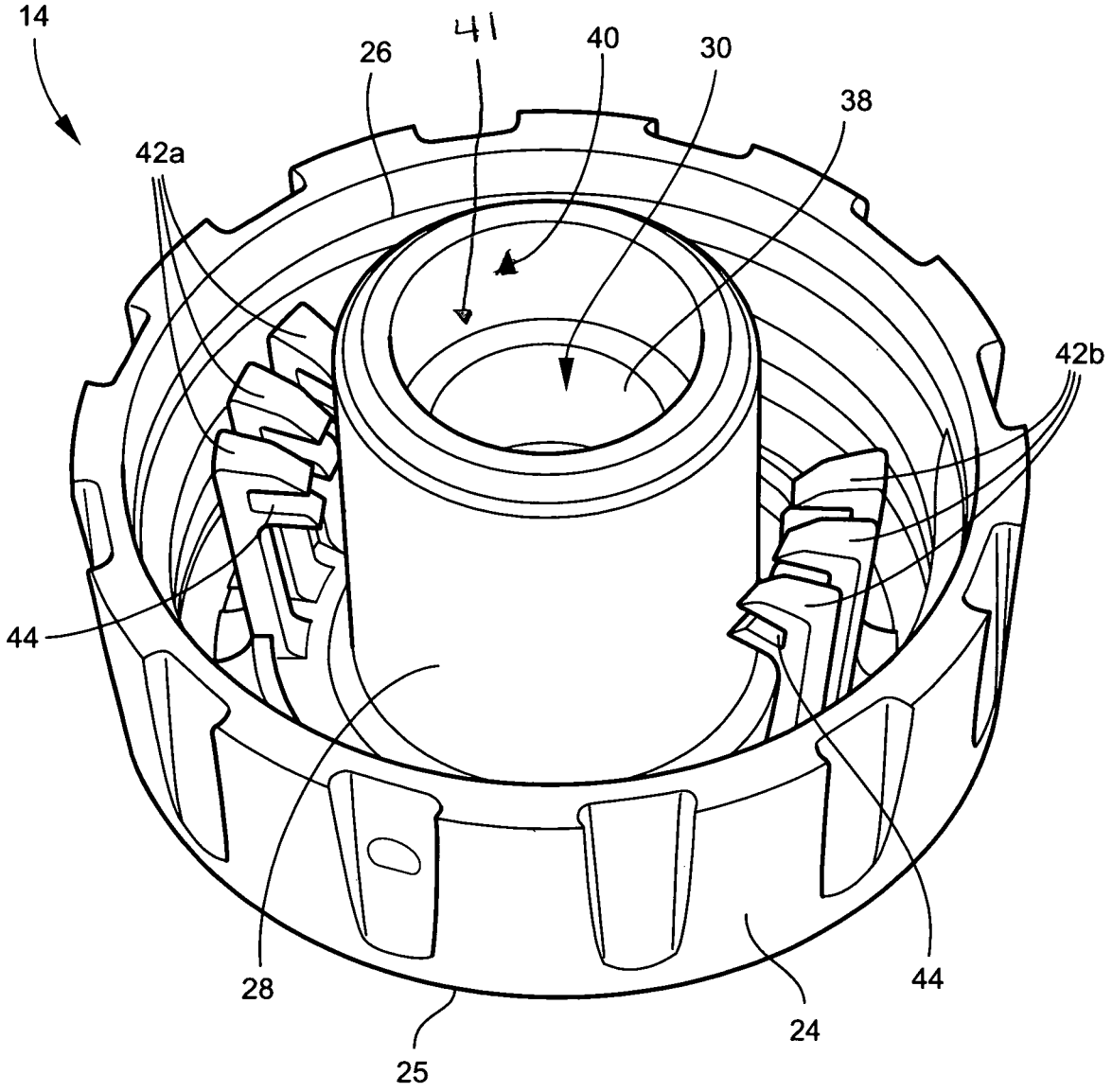
FIG. 5 is a bottom perspective view of the bottle cap of FIG. 1.

FIG. 2 is an enlarged view, partially in section, of the top portion of FIG. 1. FIG. 3 is an enlarged sectional view of the top portion of FIG. 1. FIG. 4 is a perspective view of a top portion of the charge of FIG. 1. FIG. 5 is a bottom perspective view of the bottle cap of FIG. 1.

Referring to FIGS. 2-5, a cylindrical surface 24 depends downward from an outer perimeter 25 of the top planar surface 22. Screw threads 26 are formed on an interior of the cylindrical surface 24. A central cylindrical portion 28 extends downward from the top planar surface 22 and includes a central through hole 30. An upper portion of the central through hole 30 includes an enlarged portion 32 (best seen in FIG. 3). A sleeve 34 is disposed in the enlarged portion 32.

Sleeve 34 rests on a flanged portion 36. Sleeve 34 holds detonator or blasting cap 18. Sleeve 34 may be made of, for example, rubber. Sleeve 34 may be in the form of a grommet having internal flexible portions 46 that deform and grip blasting cap 18 when cap 18 is inserted in sleeve 34. Flexible portions 46 should be stiff enough to hold blasting cap 18 in place.

A lower portion of the central through hole 30 has a first diameter segment 38 and a counter-bore 40. Counter-bore 40 has a larger second diameter 41 than the first diameter segment 38. First diameter segment 38 is configured to hold a smaller diameter tube 52 of energetic material 54 (FIG. 3) with a press fit. Energetic material 54 may include a blind hole 56 for receiving a portion of blasting cap 18. Counter-bore 40, with its larger diameter, is configured to hold a larger diameter tube of energetic material with a press fit. The smaller diameter tube 52 and larger diameter tube (not shown) may have diameters of ⅜ and ½ inch, respectively. The energetic tubes may be made of, for example, plastic. The energetic material 54 may be, for example, C-4 or detonation cord.

A plurality of lip grabbers 42 depend downwardly from the top planar surface 22. Lip grabbers 42 are disposed radially between the screw threads 26 and the central cylindrical portion 28. The plurality of lip grabbers 42 includes two sub-pluralities of lip grabbers 42*a* and 42*b* disposed on opposite sides of the central cylindrical portion 28. In the embodiment shown, there are three lip grabbers 42 on opposite sides of central cylindrical portion 28. However, other numbers of lip grabbers 42 may be used. Each lip grabber 42 may include a slot 44 configured to receive a lip 48 of a water bottle 12 (See FIG. 4, also). Slots 44 and lip 48 may form, for example, a snap fit. Lip 48 is located below external threads on the neck of water bottle 12. An O-ring 50 may be disposed at the top of the neck of water bottle 12 to seal in water.

Figure 6:
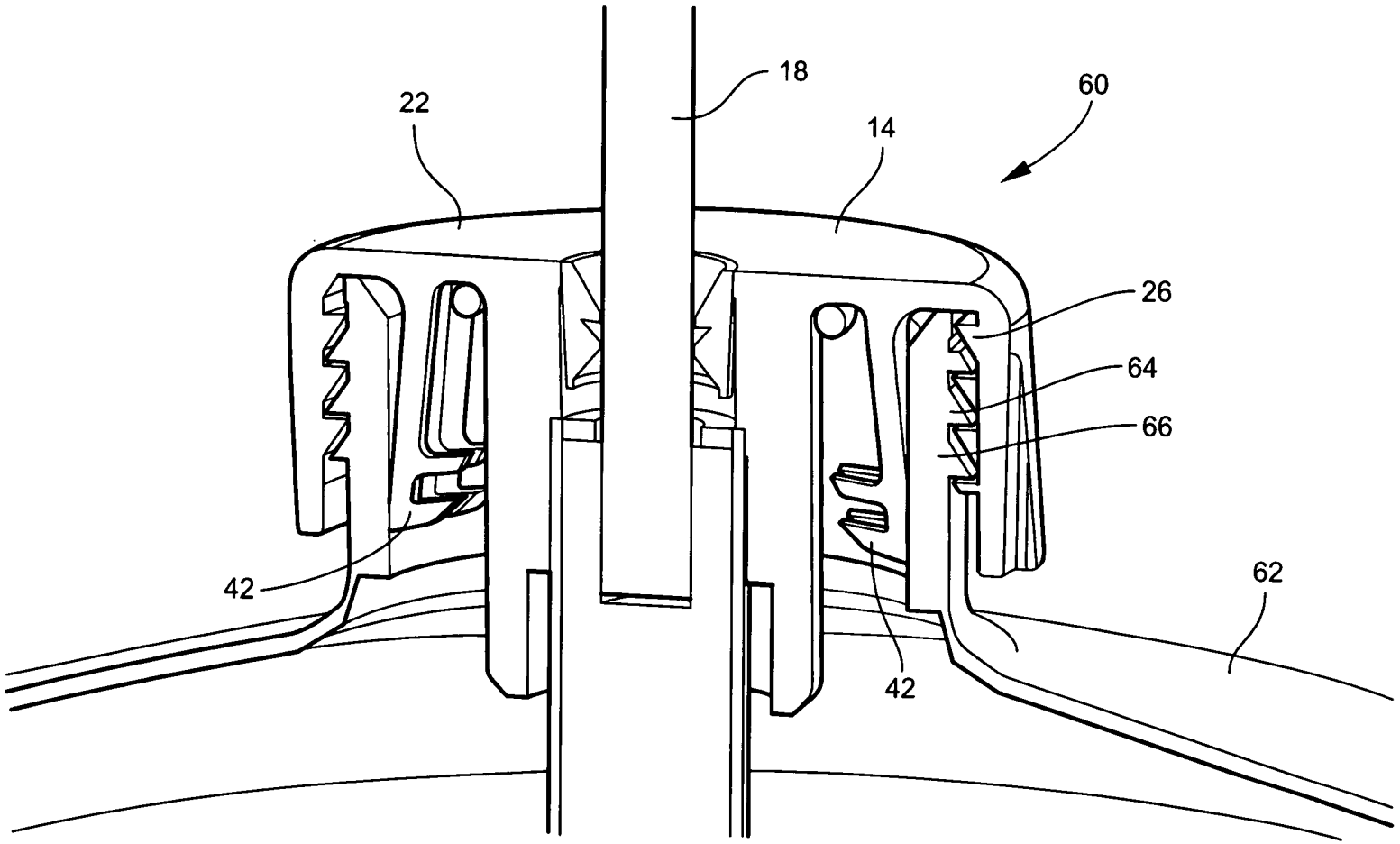
FIG. 6 is a sectional view of the top portion of another exemplary embodiment of an explosive water charge.

FIG. 6 is a sectional view of the top portion of another exemplary embodiment of an explosive water charge 60. Charge 60 includes cap 14 and a water bottle 62 with a larger diameter threaded neck, such as a HYDRAPAK STASH® collapsible water bottle. The external threads 64 on the neck 66 of the bottle 62 engage the internal screw threads 26 of cap 14. The lip grabbers 42 are not needed when cap 14 is used with bottle 62. The top planar surface 22 of the cap 14 enables the HYDRAPAK STASH® bottles 62 to be stacked either unfilled or filled with water. Of course, the stacked bottles 62 do not include the detonator 18. Stacking of bottles 62 is possible because the bottom surface of the HYDRAPAK STASH® bottle 62 includes a recess (not: shown) in which the cap 14 is nested when HYDRAPAK STASH® bottles are stacked.

Any numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A cap for an explosive water charge, comprising:

a top planar surface;

a cylindrical surface downwardly depending from an outer perimeter of the top planar surface;

screw threads being formed on an interior of the cylindrical surface;

a central cylindrical portion extending downwardly from the top planar surface and including a central through hole;

an upper portion of the central through hole including an enlarged portion;

a sleeve being disposed in the enlarged portion and resting on a flanged portion, the sleeve is configured to hold a detonator, wherein the sleeve includes internal flexible portions to grip the detonator, which comprises a blast cap;

a lower portion of the central through hole including a first diameter segment and a counter-bore with a larger second diameter than the first diameter segment; and a plurality of lip grabbers depending downwardly from the top planar surface and being disposed radially between the screw threads and the central cylindrical portion, the plurality of lip grabbers includes two sub-pluralities of lip grabbers disposed on opposite sides of the central cylindrical portion, each lip grabber includes a slot configured to receive a lip of a water bottle, wherein the central through hole includes two open ends to interface with an explosive column of an energetic material, and wherein the screw threads are situated exterior to the plurality of lip grabbers so that the plurality of lip grabbers are situated intermediate between the screw threads and the central cylindrical portion.

2. The cap of claim 1, wherein each of the two sub-pluralities of lip grabbers includes three lip grabbers.

3. The cap of claim 1, wherein the sleeve is comprised of rubber.

4. An explosive water charge, comprising:

the cap of claim 1; and a water bottle, wherein the water bottle includes a lip;

wherein the cap is fixed to the water bottle by one of external threads on the water bottle engaging with the screw threads of the cap and the lip on the water bottle engaging with the plurality of lip grabbers of the cap.

5. The charge of claim 4, wherein the water bottle is a commercial off the shelf (COTS) drinking water bottle, and wherein the cap is fixed to the water bottle by the lip on the water bottle engaging with the plurality of lip grabbers of the cap.

6. The charge of claim 4, wherein the water bottle is a collapsible water bottle, which includes an externally threaded neck, and wherein the cap is fixed to the collapsible water bottle by the external threads on the water bottle engaging with the screw threads of the cap.

7. The charge of claim 4, wherein the detonator is disposed in the cap and held by the sleeve in the cap.

8. The charge of claim 7, wherein the detonator is held with a press fit.

9. The charge of claim 7, wherein the explosive column of the energetic material is disposed in the water bottle and in the cap.

10. The charge of claim 7, wherein the explosive column of the energetic material is disposed in the water bottle and in the cap, wherein the explosive column of the energetic material engages the first diameter segment of the cap with a press fit.

11. The charge of claim 7, wherein the explosive column of the energetic material is disposed in the water bottle and in the cap, wherein the explosive column of the energetic material engages the counter-bore of the cap with a press fit.

12. The charge of claim 7, wherein the explosive column of the energetic material is disposed in the water bottle and in the cap, wherein one end of the detonator is disposed in a blind bore in the energetic material.

13. The charge of claim 7, wherein the explosive column of the energetic material is disposed in the water bottle and in the cap, wherein the energetic material is one of C-4 and a detonation cord.

14. The cap of claim 1, wherein the cap is a rigid cap.

15. An explosive water charge, comprising:

a cap, including atop planar surface;

a cylindrical surface downwardly depending from an outer perimeter of the top planar surface;

screw threads formed on an interior of the cylindrical surface;

a central cylindrical portion extending downwardly from the top planar surface and including a central through hole;

an upper portion of the central through hole including an enlarged portion;

a sleeve disposed in the enlarged portion and resting on a flanged portion, the sleeve is configured to hold a detonator, wherein the sleeve includes internal flexible portions to grip the detonator, which comprises a blast cap;

a lower portion of the central through hole having a first diameter segment and a counterbore with a larger diameter than the first diameter segment; and a plurality of lip grabbers depending downwardly from the top planar surface and disposed radially between the screw threads and the central cylindrical portion, the plurality of lip grabbers including two sub-pluralities of lip grabbers disposed on opposite sides of the central cylindrical portion; and a water bottle, wherein the water bottle includes a lip, wherein each lip grabber includes a slot configured to receive the lip of the water bottle;

wherein the cap is fixed to the water bottle by engaging external threads on the water bottle with the screw threads of the cap, wherein the central through hole includes two open ends to interface with an explosive column of an energetic material, and wherein the screw threads are situated exterior to the plurality of lip grabbers so that the plurality of lip grabbers are situated intermediate between the screw threads and the central cylindrical portion.

16. An explosive water charge, comprising:

a cap; and a water bottle, wherein the water bottle includes a lip, wherein the cap comprises a top planar surface; a cylindrical surface downwardly depends from an outer perimeter of the top planar surface; screw threads formed on an interior of the cylindrical surface; a central cylindrical portion extends downwardly from the top planar surface and includes a central through hole, an upper portion of the central through hole includes an enlarged portion, a sleeve disposed in the enlarged portion and rests on a flanged portion, the sleeve configured to hold a detonator, a lower portion of the central through hole includes a first diameter segment and a counter-bore with a larger diameter than the first diameter segment, and a plurality of lip grabbers depends downwardly from the top planar surface and disposed radially between the screw threads and the central cylindrical portion, the plurality of lip grabbers includes two sub-pluralities of lip grabbers disposed on opposite sides of the central cylindrical portion, and each lip grabber includes a slot configured to receive the lip of the water bottle, and wherein the cap is fixed to the water bottle by the lip of the water bottle engaging with the plurality of lip grabbers of the cap, wherein the central through hole includes two open ends to interface with an explosive column of an energetic material, and wherein the screw threads are situated exterior to the plurality of lip grabbers so that the plurality of lip grabbers are situated intermediate between the screw threads and the central cylindrical portion.

17. A cap for an explosive water charge, comprising:

a top surface;

a cylindrical surface downwardly depending from an outer perimeter of the top surface;

screw threads being formed on an interior of the cylindrical surface;

a central cylindrical portion extending downwardly from the top surface and including a central through hole;

an upper portion of the central through hole including an enlarged portion;

a sleeve being disposed in the enlarged portion, the sleeve configured to hold a detonator, wherein the sleeve includes internal flexible portions to grip the detonator, which comprises a blast cap;

a lower portion of the central through hole including a first diameter segment and a counterbore with a larger second diameter than the first diameter segment; and lip grabbers depending downwardly from the top surface and being disposed radially between the screw threads and the central cylindrical portion, wherein the lip grabbers include two sub-pluralities of lip grabbers disposed on opposite sides of the central cylindrical portion, and wherein each of the lip grabbers includes a slot configured to receive a lip of a water bottle to thereby form a snap fit with the lip, wherein the central through hole includes two open ends to interface with an explosive column of an energetic material, and wherein the screw threads are situated exterior to the lip grabbers so that the lip grabbers are situated intermediate between the screw threads and the central cylindrical portion.

* * * * *